US005181612A

United States Patent [19]

Liu

[11] Patent Number: 5,181,612

[45] Date of Patent: Jan. 26, 1993

[54] COMPACT COLLAPSIBLE LUNCH BOX

[76] Inventor: Yuan W. Liu, 1031 Denise Street, Timmins, Ontario, Canada, P4P 1C3

[21] Appl. No.: 782,653

[22] Filed: Oct. 25, 1991

[51] Int. Cl.[5] ..... A45C 11/20

[52] U.S. Cl. ..... 206/546; 206/542; 220/4.28; 220/23.4; 220/521; 62/457.7

[58] Field of Search ..... 206/514, 542, 544, 545, 206/546; 220/4.28, 23.4, 23.83, 521, 522; 64/457.7; 190/102, 107, 109, 111

[56] References Cited

U.S. PATENT DOCUMENTS

| | | | |
|---|---|---|---|
| 362,948 | 5/1887 | Galbreth | 206/546 |
| 417,979 | 12/1889 | Borcherdt | 220/522 |
| 622,263 | 4/1899 | Pritchard et al. | 190/111 |
| 1,502,987 | 7/1924 | Glass et al. | 190/111 |
| 1,510,763 | 10/1924 | Canal | 190/111 |
| 2,245,999 | 6/1941 | Plotkin | 190/109 |
| 2,439,004 | 4/1948 | Hurley | 220/522 |
| 2,457,043 | 12/1948 | Histand | 206/545 |
| 2,613,804 | 10/1952 | Hughes | 206/545 |
| 2,615,563 | 10/1952 | Sundberg et al. | 220/522 |
| 2,672,232 | 3/1954 | Kessell, Jr. | 220/522 |

FOREIGN PATENT DOCUMENTS

| | | | |
|---|---|---|---|
| 1394113 | 2/1965 | France | 62/457.7 |

*Primary Examiner*—David T. Fidei
*Attorney, Agent, or Firm*—David W. Wong

[57] ABSTRACT

This compact lunch box consists of a collapsible carrier body and a collapsible lower casing both having walls made of a thermal insulative material. In the erected state, the lower casing may be removably mounted with a plurality of mounting webs at the bottom side of the carrier body for containing food and beverage. A thermal pack is provided in a well located within the carrier body for maintaining the food and beverage in a low healthy temperature. In the collapsed state, the lower casing can also be conveniently mounted at the bottom of the carrier body to form a compact assembly which can be stored in a briefcase or a school bag.

9 Claims, 3 Drawing Sheets

COMPACT COLLAPSIBLE LUNCH BOX

BACKGROUND OF THE INVENTION

This invention relates to a lunch box for carrying food and beverage, and particularly to a lunch box having a container therein which is foldable and collapsible when not in use.

Lunch boxes are commonly used to carry food and beverage to be consumed ordinarily at lunch time by the user, and they are widely used by school children for such purpose. Heretofore, lunch boxes have been relatively odd in shape and size so that they may not be placed within other carrying cases such as a briefcase or a school bag. Thus, the lunch box even when not in use or after the food and beverage have been consumed becomes an extra non-use item which has to be hand-carried by the user. Such an additional hand carrying item is particularly objectionable to active school children. Furthermore, most lunch boxes do not have provisions to maintain the food and beverage in a good healthy condition for consumption. The spoilage of food is normally due to the inability of the lunch box to maintain the food in a low temperature particularly in the hot summer season; thus, the food becomes unsafe for consumption.

SUMMARY OF THE INVENTION

It is therefore a principal object of the present invention to provide a lunch box including a removable containing having a collapsible construction.

It is another object of the present invention to provide a compact lunch box with a food and beverage container which may be converted into a substantially flat collapsed assembly when not in use such that the lunch box has a compact size for storage in a carrying bag.

It is yet another object of the present invention to provide a lunch box which can efficiently maintain the food and beverage contained therein in a healthy condition for consumption.

The lunch box comprises a carrier body member having a cover means pivotally provided on a top surface portion therein. The carrier body member has a well formed in a top portion therewithin and a bottom casing formed in a bottom portion therein. The well and the bottom casing are in communication with each other through at least a large rectangular opening formed at the base of the well. A collapsible container member is operatively and removably mounted in the bottom casing of the carrier body member. The container member has foldable side walls which are operative to position in a manner perpendicular to a bottom panel of the container member. A plurality of securing web means are provided in the bottom edges of the bottom casing, and a plurality of associated securing web means are provided on the side walls of the container member. The securing web means and associated securing web means are operative to secure the carrier body member and the container member together removably.

Other and further objects, features, and advantages of the present invention will be apparent from the following description of the preferred embodiment thereof, given for the purpose of disclosure and taken in conjunction with the accompanying drawings.

DESCRIPTION OF THE DRAWINGS

In the drawing forming a part of the disclosure herein.

DESCRIPTION OF THE PREFERRED EMBODIMENT

Figure 1:
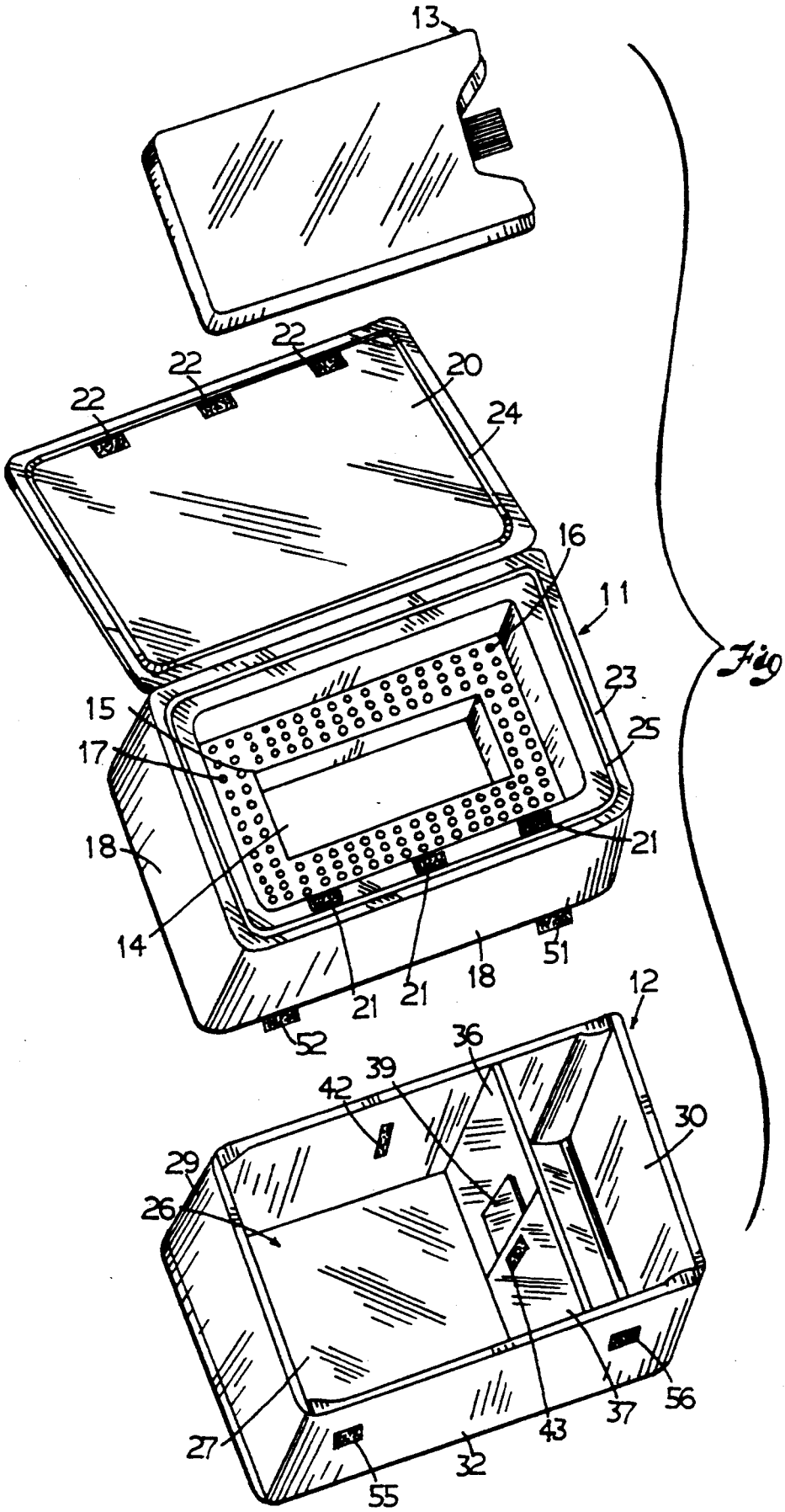
FIG. 1 is an exploded perspective view of the lunch box according to the present invention showing the various components therein.
Figure 2:
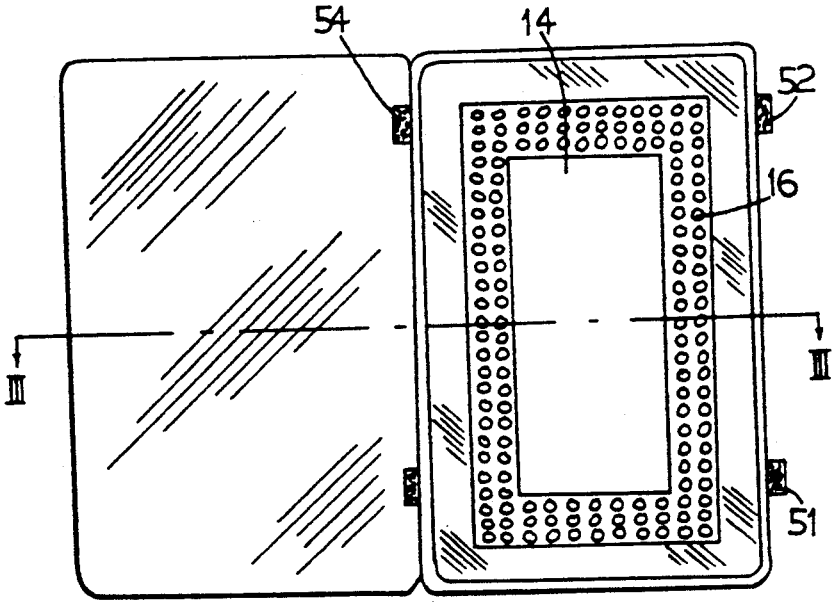
FIG. 2 is a bottom perspective view of the carrier body member of the lunch box according to the present invention.
Figure 3:
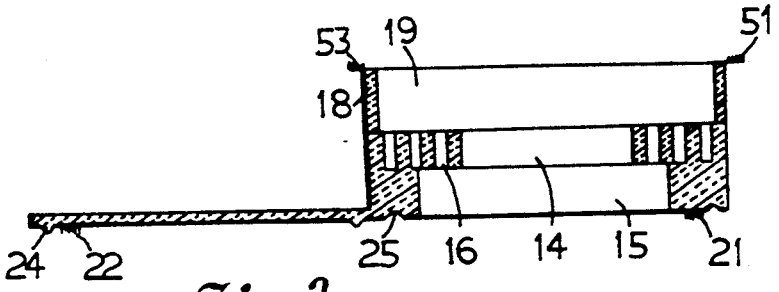
FIG. 3 is the sectional side view of the carrier body member thereof along section line III—III of FIG. 2.
Figure 4:
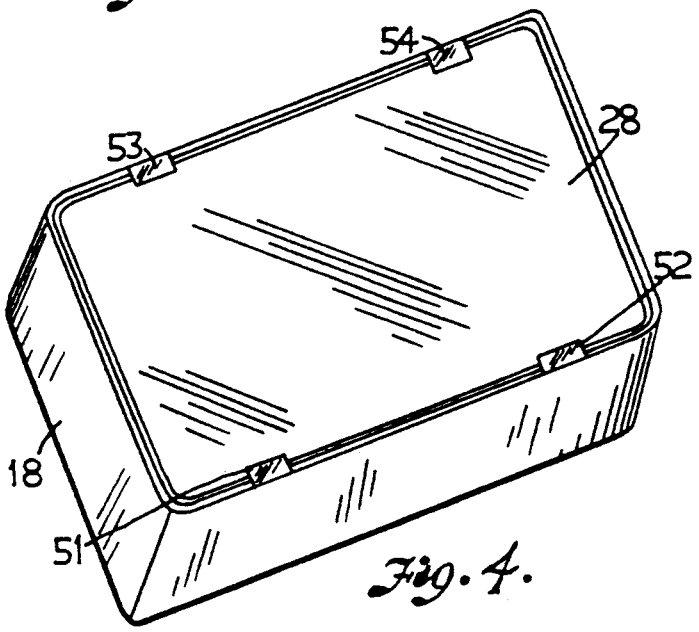
FIG. 4 is a bottom perspective view of the lunch box according to the present invention with the container member thereof in a folded collapsed condition and mounted within the bottom casing of the carrier body member.
Figure 5:
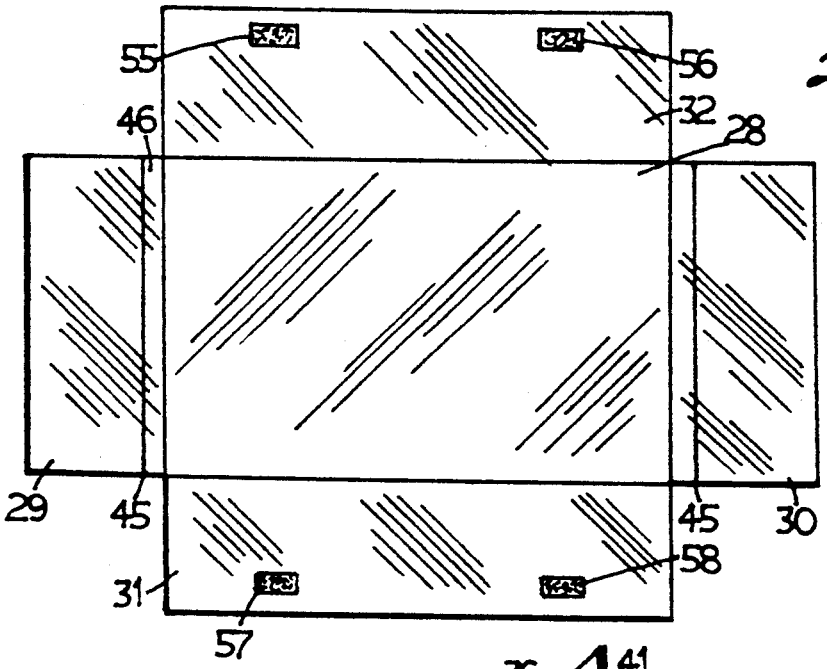
FIG. 5 is a bottom perspective view of the container member thereof in an unfolded erected condition.

Referring now to the drawings wherein like reference numerals designate the same parts in the various views, the lunch box 10 of the present invention consists primarily of a main carrier body 11, a container member 12 and a temperature maintenance bottle 13.

The carrier body member 11 is substantially rectangular in overall shape and it is made of a light weight thermal insulation material such as styrofoam. A rectangular shallow well 14 is formed in the top portion of the carrier body member 11. The well 14 is dimensioned to accommodate the thermal maintenance bottle 13 to be disposed snugly therein. The bottom of the well has a large rectangular opening 15 and a plurality of through openings 16 formed on the shoulder portion 17 of the bottom of the well 14. The side walls 18 of the carrier body member 11 extend below the bottom of the well to form a rectangular casing 19 at the bottom therein. The carrier body member 11 has a cover 20 hingedly secured to the latter. The cover 20 is also made of the same thermal insulation material as the carrier body member 11 and it may be maintained in a closed position by cooperative securing web means such that commonly known as Velcro (trade mark) strips 21 and 22 provided at the top surface 23 of the carrier body member 11 and at the cover 20 respectively as best shown in FIG. 1. The temperature maintenance bottle 13 is a plastic bottle preferably filled with a freezable liquid commonly known as thermal gel which can maintain in a frozen condition, once it has been frozen, for a relatively long period of time. A surrounding ridge 24 is formed on the cover 20, and an associated surrounding channel 25 is formed on the top surface 23 of the carrier body member 11. The ridge 24 will engage with the channel 25 when the cover 20 is closed over the top surface 23 to maintain a tight thermal seal therebetween. The ridge 24 may be either integrally formed on the cover 20 or provided by mounting a resilient strip onto the cover.

Figure 6:
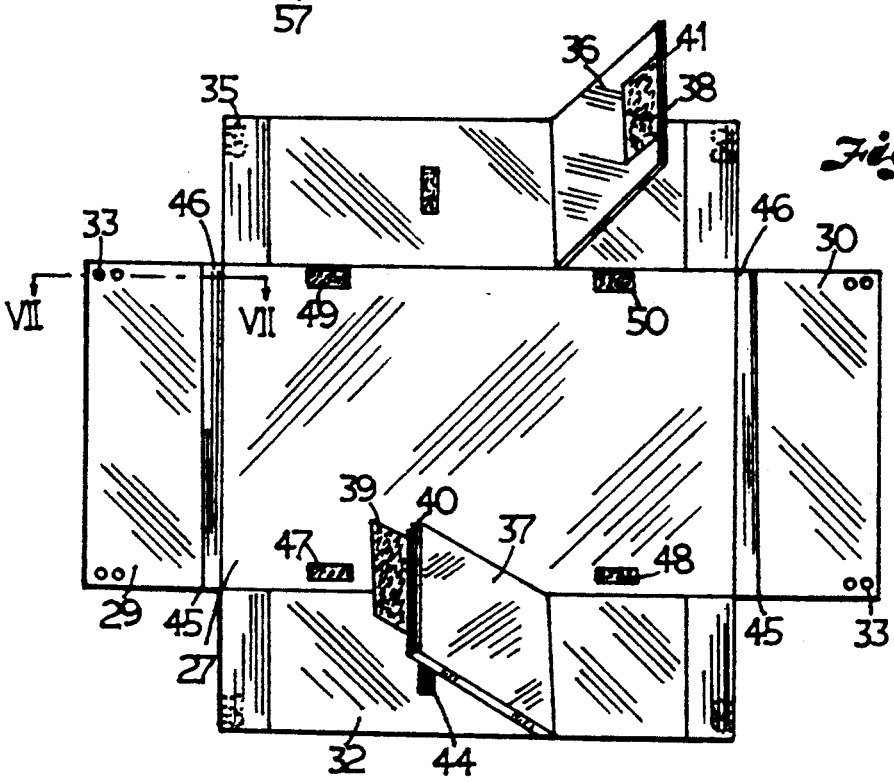
FIG. 6 is a top perspective view of the container member in the unfolded partially erected condition.
Figure 7:
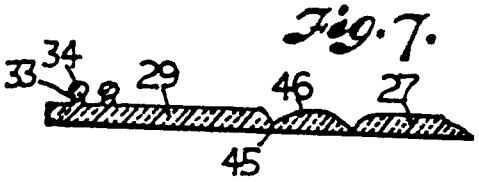
FIG. 7 is an isolated enlarged sectional side view along section line VII—VII of FIG. 6 showing the short side wall construction and the latch pins configuration.
Figure 8:
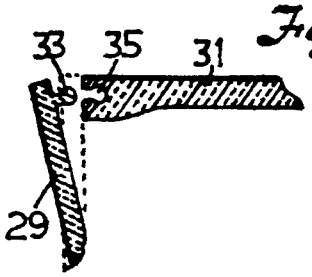
FIG. 8 is an isolated enlarged partial sectional top view of the snap-fitting latch pin and latch bore in the short side panel and the long side panel of the container member of the lunch box of the present invention.

The container member 12 has a rectangular bottom panel 26 which has a top surface 27 and a bottom surface 28, two short side panels 29 and 30 and two long side panels 31 and 32 respectively. The side panels 29, 30, 31 and 32 are hingedly connected to the bottom panel 26 and they may be folded over onto the bottom surface 28 in a collapsed condition. These side panels 29, 30, 31 and 32 may be turned to the erected position located at right-angled to the top surface 27 to form a rectangular container as best shown in FIG. 1. The short side walls 29 and 30 are maintained in an erected position by latching pin 33 provided at the two upper edge portions of the short side walls. These pins 33 have a slightly enlarged head portion 34 which can intimately and snugly engage in a snap action with a similarly shaped substantially cylindrical bore 35 formed at two upper edge portions of the long side walls 31 and 32 as best shown in FIGS. 7 and 8. The container cavity of the container member 12 is divided into two compartments by two dividing panels 36 and 37 hingedly secured to the long side panels 31 and 32 respectively. A securing web means 38 is provided at the free side edge portion of the dividing panel 36, and an extending securing web means 39 is also provided at the free side edge of the dividing panel 37 and extending outwards therefrom beyond the free edge therein as best shown in FIG. 6. The securing web means 38 and 39 engage each other to secure the two dividing panels together when the container member 12 is in the erected condition. The engagement of the securing web means 38 and 39 also reinforces the erected condition of the container member 12. In addition to the securing web means 38 and 39 an extension ridge 40 may be formed along the entire free edge of either one of the dividing panels and an associated channel 41 is formed along the entire free edge of the other dividing panel. The extension ridge 40 and the associated channel 41 have a complementary shape such that they will lockingly engage each other selectively to hold the two dividing panels in a locked position to ensure the container member 12 is in a secure erected condition. The securing web means 38 engages with a securing web means 42 provided on the long side wall 31 when the container member 12 is in the folded condition; similarly, securing web means 43 and 44 are respectively provided on the dividing panel 37 and long side panel 32 for maintaining the dividing panel 37 in the folded condition.

To convert the container member 12 into a folded collapsed condition, the securing webs 38 and 39 as well as the ridge 40 and channel 41 are first disengaged, and the dividing panels 36 and 37 are folded against the side panels 31 and 32 until the securing web means 38 engages 42, and 43 engage 44 to hold the dividing panels securely in the folded state. The long and short side panels are then separated from one another by disengaging the latching pins 33 from the associated bores 35, then the long side panels are folded over 360 degrees to lie substantially flatly to lie over the bottom surface 28 of the container member 12. The short side panels 29 and 30 are then turned 360 degrees to lie over the folded long side panels 31 and 32 respectively. The edge portions of the long side panels 31 and 32 have a larger thickness so as to provide higher rigidity therein for the formation of the latching bores 35. When the container member 12 is in the folded condition, in order to compensate for the additional height of such thicker edge portions of the long side panels in the folded position, the short side panels 29 and 30 are each foldable along a transverse line 45 located at a short distance from the joining edge to the bottom panel 26. The short portion 46 thus formed has a width equal to the thickness of the edge portion of each long side panel in the folded position. Thus, the short side panels 29 and 30 can be folded over to lie flatly over the already folded long side panels 31 and 32. The folded container member 12 may be placed into the rectangular casing 19 at the bottom of the carrier body member 11 and secured in place by securing web means 47, 48, 49 and 50 provided on the bottom surface 27 of the container member 12, and securing web means 51, 52, 53 and 54 provided on the bottom edge portion of the long side panels 18 of the carrier body member 11.

Securing web means 55, 56, 57 and 58 are provided at the upper edge portion of the long side panels 31 and 32 of the container member 12 so that in the erected conditions the container member 12 can engage at the bottom of the carrier body member 11 with the securing webs 51, 52, 53 and 54 cooperative with the securing web means 55, 56, 57 and 58 respectively to secure the container member in place.

When the container member 12 is not in use or after the food and beverage have been consumed, it can be collapsed in the folded condition to form a folded assembly which can be placed and mounted in the casing 19 of the carrier body 11 such that the lunch box assembly becomes primarily the size of the carrier body member 11 which, for example, can typically have overally dimensions of about 23 centimeters by 15 centimeters by 4.5 centimeters similar to the overall dimensions of a standard text book and can be conveniently accommodated in a briefcase or a school bag.

When it is required to carry food and beverage, the container member 12 can be quickly and easily removed from the casing 19 by disengaging the securing web means 51, 52, 53 and 54 on the carrier body member 11 from the securing web means 47, 48, 49 and 50 on the bottom surface 27 of the container assembly, and the container member 12 can be erected as described above. Beverage in a small bottle or a vacuum packed size beverage can be placed in the smaller compartment and sandwiches or similar food can be placed in the larger compartment therein. The carrier body member 11 may then be placed over the container member 12 and be secured thereto by engaging the securing web means 51, 52, 53 and 54 on the carrier body member 11 with the securing web means 55, 56, 57, and 58 provided on the long side panels 33 and 32 of the container member 12. The frozen temperature maintenance bottle 13 may be placed into the well 14 and enclosed in place by the cover 25 which is secured to the carrier body member 11 by engaging the securing web means 22 on the cover with the securing web means 21 on the top surface of the shoulder 23 of the carrier body member 11. The large opening 15 allows maximum cooling of the food and beverage in the container member 12 by the temperature maintenance bottle 13. If it is desired, the temperature maintenance bottle 13 may either be filled with cold beverage, or hot beverage selectively for maintaining the food in the desirable cold or hot condition for a relatively extended period of time. Furthermore, a foldable or collapsible handle may be incorporated on the side of the carrier body member 11 to facilitate carrying of the lunch box if so desired.

Obviously, numerous modifications and variations of the present invention are possible in light of the above teachings. It is therefore to be understood that within the scope of the appended claims, the invention may be practiced otherwise than as specifically described herein.

What is claimed is:

1. A compact collapsible lunch box comprising, a carrier body member having a cover means hingedly provided on a top portion therein, said carrier body member having a well portion formed in said top portion and a bottom casing portion formed in a bottom portion therein, said well portion and said bottom casing portion being in communication with each other through at least a rectangular opening formed at a base of said well portion, a collapsible container member operatively and removably mounted in said bottom casing portion of said carrier body member, said container member having foldable side walls operative to position in a manner perpendicular to a bottom panel in said container member to form a substantially rectangular container therewith, a plurality of securing web means disposed in the bottom edges of said bottom casing portion, a plurality of associated securing web means disposed on the side walls of said container member, said securing web means and associated securing web means being operative to secure removably together said carrier body member and said container member.

2. A compact collapsible lunch box according to claim 1 wherein said side walls of said container member are foldable to lie flatly over said bottom panel to form a collapsible assembly, said bottom panel having a bottom surface, a plurality of additional securing web means disposed on said bottom surface, said additional securing web means being operative in conjunction with said securing means on said bottom casing portion for securing said collapsible assembly in said bottom casing portion of said carrier body member.

3. A compact collapsible lunch box according to claim 1 wherein said container member has two mutually opposite long side walls, one dividing panel means pivotally mounted on one long side wall, and a second dividing panel means pivotally mounted to the second long side wall, said one dividing panel means being operative selectively to lie flatly over and perpendicularly to said one long side wall, said second dividing panel means being operative selectively to lie flatly over and perpendicularly to said second long side wall.

4. A compact collapsible lunch box according to claim 3 wherein said one dividing panel means includes a free edge portion having a securing web means disposed thereon, and said second dividing panel means includes a free edge having an extending securing web means disposed thereon and extending outwards therefrom, said securing web means on said one dividing panel means and said extended securing web means being operative cooperatively to secure said one dividing panel means and said second dividing panel means together removably to form a partition panel within said container member when said container member is in an erected condition.

5. A compact collapsible lunch box according to claim 4 wherein said cover means, said carrier body member and said container member are made of a thermal insulation material.

6. A compact collapsible lunch box according to claim 5 wherein said well portion includes a shoulder portion around said rectangular opening, said shoulder portion having a plurality of through openings formed therein, said well portion and said bottom casing portion in said carrier body member being also in communication with each other through said through openings.

7. A compact collapsible lunch box according to claim 6 including a first plurality of securing web means disposed on said top portion of said carrier body member, a second plurality of securing web means disposed on said cover means, said first plurality of securing web means and said second plurality of securing web means being operative to cooperate with one another to secure said cover means detachably over said carrier body member.

8. A compact collapsible lunch box according to claim 7 wherein said container member includes two mutually opposite short side walls, latching means disposed at two top corner portions of said short side walls, associated latching means formed at two top edge portions of said long side walls, said latching means and said associated latching means being operative to secure said short side walls and said long side walls in a position perpendicular to said bottom panel for maintaining said container member in an erected condition.

9. A compact collapsible lunch box according to claim 8 wherein said latching means are substantially cylindrical pins having an enlarged head portion, and said associated latching means are substantially cylindrical bores having a configuration complementary to said cylindrical pins whereby said cylindrical pins are intimately and removably engageable with said cylindrical bores to maintain said short side walls securely mounted to said long side walls when said container member is in said erected condition.

* * * * *